US008555597B2

(12) United States Patent
Walther

(10) Patent No.: US 8,555,597 B2
(45) Date of Patent: Oct. 15, 2013

(54) DECK-TO-BUILDING LATERAL-LOAD CONNECTOR

(75) Inventor: Bernd Walther, Efringen-Kirchen (DE)

(73) Assignee: GRK Canada Ltd., Thunder Bay (CA)

( * ) Notice: Subject to any disclaimer, the term of this patent is extended or adjusted under 35 U.S.C. 154(b) by 15 days.

(21) Appl. No.: 13/231,038

(22) Filed: Sep. 13, 2011

(65) Prior Publication Data

US 2012/0233957 A1 Sep. 20, 2012

(30) Foreign Application Priority Data

Sep. 16, 2010 (CA) ..... 2714848

(51) Int. Cl.

| | |
|---|---|
| ***E04B 1/38*** | (2006.01) |
| ***E04B 1/98*** | (2006.01) |
| ***E04C 5/00*** | (2006.01) |
| ***E04H 12/00*** | (2006.01) |
| ***E04H 9/02*** | (2006.01) |

(52) U.S. Cl.

USPC ..... 52/712; 52/285.1; 52/167.1; 52/655.1; 52/703

(58) Field of Classification Search

USPC ..... 52/223.3, 281, 291, 223.1, 655.1, 703, 52/712, 714, 702, 795, 167.1, 707, 704, 52/379, 513, 248, 285.1, 285.2, 285.3, 52/285.4, 295; 248/499, 500, 505; 24/129 R, 129 D, 115 H, 115 K, 116 R, 24/131 R, 129 C; 294/154, 157

See application file for complete search history.

(56) References Cited

U.S. PATENT DOCUMENTS

| | | | | | |
|---|---|---|---|---|---|
| 2,093,872 | A | * | 9/1937 | McCoy | 174/208 |
| 2,647,943 | A | * | 8/1953 | Kreisler | 174/207 |
| 2,932,072 | A | * | 4/1960 | Pruchnow | 24/129 A |
| 3,376,034 | A | * | 4/1968 | Ondrejka | 267/71 |
| 4,286,497 | A | * | 9/1981 | Shamah | 411/342 |
| 4,294,156 | A | * | 10/1981 | McSherry et al. | 411/345 |
| 4,650,386 | A | * | 3/1987 | McSherry et al. | 411/340 |
| 4,666,229 | A | * | 5/1987 | Grand | 439/451 |
| 4,744,192 | A | | 5/1988 | Commins | |

(Continued)

FOREIGN PATENT DOCUMENTS

| | | |
|---|---|---|
| CA | 2148590 | 5/1994 |
| CA | 2337157 | 12/1999 |
| CA | 2362168 | 8/2000 |
| CA | 2585161 | 6/2006 |

OTHER PUBLICATIONS

Final Office Action dated Jun. 24, 2013 in U.S. Appl. No. 13/270,367.
Office Action dated Apr. 15, 2013 in U.S. Appl. No. 13/270,367.

(Continued)

*Primary Examiner* — Andrew Triggs
(74) *Attorney, Agent, or Firm* — Snell & Wilmer L.L.P.

(57) ABSTRACT

A connector device for connecting an exterior deck structure to a contiguous building the connector having a pair of interlocked non-contacting cable loops, with a plastic plug encapsulating the interlocked ends of the cables and separating the cables to act as a thermal barrier. An expanded head at one end of the plug, with associated foam washer seals against a deck header. The exterior cable end of the connector is attached to a deck joist and the interior end of the connector is attached to a building joist, wherein the respective joists may be laterally offset. The connector prevents detachment of the deck from the building during severe tectonic of weather activities.

13 Claims, 5 Drawing Sheets

(56) References Cited

U.S. PATENT DOCUMENTS

| | | | | |
|---|---|---|---|---|
| 4,810,146 | A | 3/1989 | Sinclair | |
| 4,912,816 | A * | 4/1990 | Brandt | 24/129 R |
| 5,702,218 | A | 12/1997 | Onofrio | |
| 5,898,987 | A | 5/1999 | Onofrio | |
| 5,950,284 | A * | 9/1999 | Persson | 24/129 R |
| 6,161,999 | A * | 12/2000 | Kaye et al. | 411/344 |
| 6,490,840 | B1 | 12/2002 | Thompson | |
| 6,862,854 | B1 | 3/2005 | Fitzmyers | |
| 7,086,803 | B2 * | 8/2006 | Ackerman et al. | 403/210 |
| 7,562,494 | B2 | 7/2009 | Platts | |
| 7,849,658 | B2 | 12/2010 | Platts | |
| 2005/0016114 | A1 | 1/2005 | Thompson | |
| 2009/0249738 | A1 * | 10/2009 | Brereton et al. | 52/741.2 |
| 2012/0233957 | A1 * | 9/2012 | Walther | 52/707 |
| 2012/0260600 | A1 * | 10/2012 | Walther | 52/712 |

OTHER PUBLICATIONS

Advisory Action dated Mar. 21, 2013 in U.S. Appl. No. 13/270,367.
Final Office Action dated Feb. 27, 2013 in U.S. Appl. No. 13/270,367.
Office Action dated Nov. 29, 2012 in U.S. Appl. No. 13/270,367.

* cited by examiner

DECK-TO-BUILDING LATERAL-LOAD CONNECTOR

FIELD OF DISCLOSURE

The present invention relates to a connector for securely tying an exterior deck structure to the interior framing or structure of a building. Such a connector is desirable to retain a deck structure integrally with the building to which it is attached, particularly in turbulent conditions including high winds, hurricanes and particularly earthquakes.

BACKGROUND OF THE INVENTION

Typically, wooden decks extend from the side of a building or house structure, and at the building wall are attached to the building structure by means of a ledger board from which joists and remaining deck structure elements extend. In the past, ledger boards have simply been nailed or lagged to the building structure, typically through the exterior cladding, sheathing and into a framing joist or header. Under tensile load, the lag screws or nails can readily fail, allowing the deck ledger board to be detached, and thereby allowing the deck to fall freely. Thus, a means for retaining the ledger board, together with the deck structure, securely in place to prevent the consequences of falling, particularly under turbulent conditions, is desirable.

BACKGROUND ART

While through bolts have been employed in the past to interconnect the ledger board of the deck with a header of the building structure, and can have increased tensile resistance if washer and nut connections are used on either end, these typically are attached solely to the header and placed undue stress on the header during an earthquake and other turbulence.

Other means, such as Simpson™ Strong-Tie™ devices, such as outlined in FIG. 1, including model DTT2Z, provide a pair of flanged metal components, one of which is attached to an exterior deck joist adjacent the ledge board and another is placed on an interior joist of the building, adjacent the header, with a threaded metal rod extending between the two metal brackets. This provides increased security by tying a deck joist directly to a building joist. The device, however, is only practical where the deck joist and the building joist are in substantial alignment, and cannot be installed where there is a significant lateral off-set between the two joists. Furthermore, the device requires a metal rod to pass from the exterior of the building to the interior, thus conducting any temperature gradient into the building, often resulting in formation of condensation, frost, rust and corrosion, not to say mold and wood rot, in the building, which can ultimately result in failure of the connector and surrounding structure.

The present invention overcomes the foregoing problems of existing connectors by providing an insulated, non-thermal conducting, connector which is also adapted to installation where the respective exterior and interior joists are not aligned.

BRIEF DESCRIPTION OF THE DRAWINGS

The invention can be seen and understood from the accompanying drawings, illustrating a preferred embodiment of the invention.

DESCRIPTION OF THE INVENTION

Figure 1A:
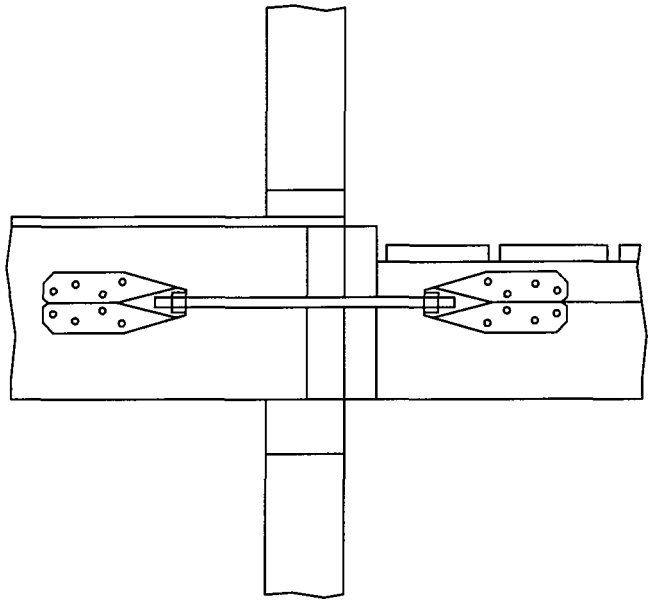
PRIOR ART FIG. 1A
FIGS. 1A and 1B respectively are profile and plan views illustrating a prior art metal rod connector, connecting interior and exterior aligned joists.
Figure 1B:
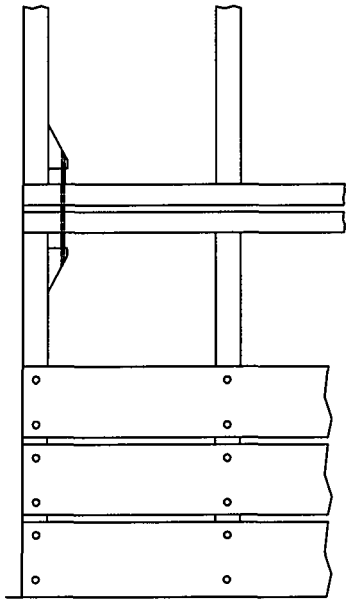
PRIOR ART FIG. 1B
Figure 2:
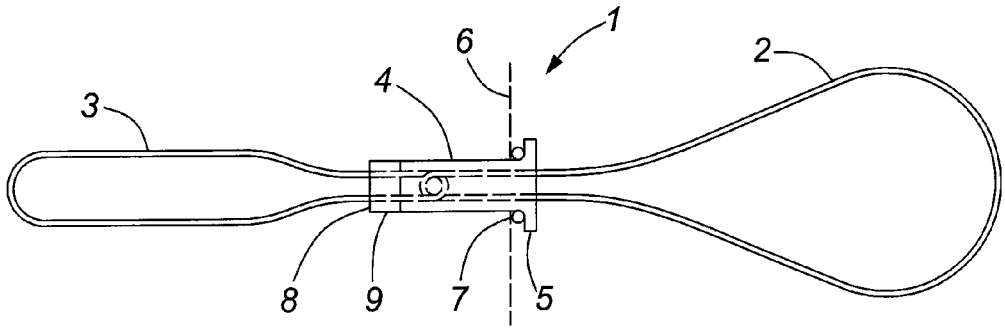
FIG. 2 illustrates the interlocked loop connector of the present invention.

As may be seen in FIG. 2, the connector (1) in one embodiment of the present invention comprises a pair of wire rope or cable loops (2) and (3). The wire loops are intertwined, one loop passing through the other, but not in contact each other, (hereinafter called 'interlocked'). Rather, the loops are constrained within a PVC or other suitable plastic plug (4) which encases the wire loops and separates them from contact.

In accordance with one embodiment of the present invention, the connector comprises two loops (2, 3) having an axial extent of about 3 feet, and an intermediate plastic plug (4) of about 5 inches in length and 1 inch diameter, with an enlarged head (5) of about 2 inches in diameter and ½ inch thickness. An aluminum or steel collar (9) extends over the opposite end (8) of the plug (4) and may be tapered to ease access of the plug into the bore hole during installation. In practice, it has been found effective that the loop may be 5 mm diameter high tensile wire cable, with a 1500 pound load capacity (4500 pound Ultimate Load). Alternatively a pair of link chains may be used to the same effect.

One end (5) of the plastic plug (4) has an enlarged head portion, and when installed is intended to contact the face of a deck ledger board (shown at dashed line 6) on the exterior of a building structure. A foam washer (7) serves to provide a sealing contact between the enlarged head and the ledger board. At the other end (8) of the plug, an optional metallic ring or collar (9) surrounds the plastic end and serves to strengthen the end in circumstances of lateral forces being applied to the cable. The plastic material of the plug isolates the respective metal loops (2, 3) and acts as a thermal barrier whereby temperatures imposed on the exterior of the loop (2) by extremes of ambient weather conditions are not transmitted to the interior loop (3).

Figure 3:
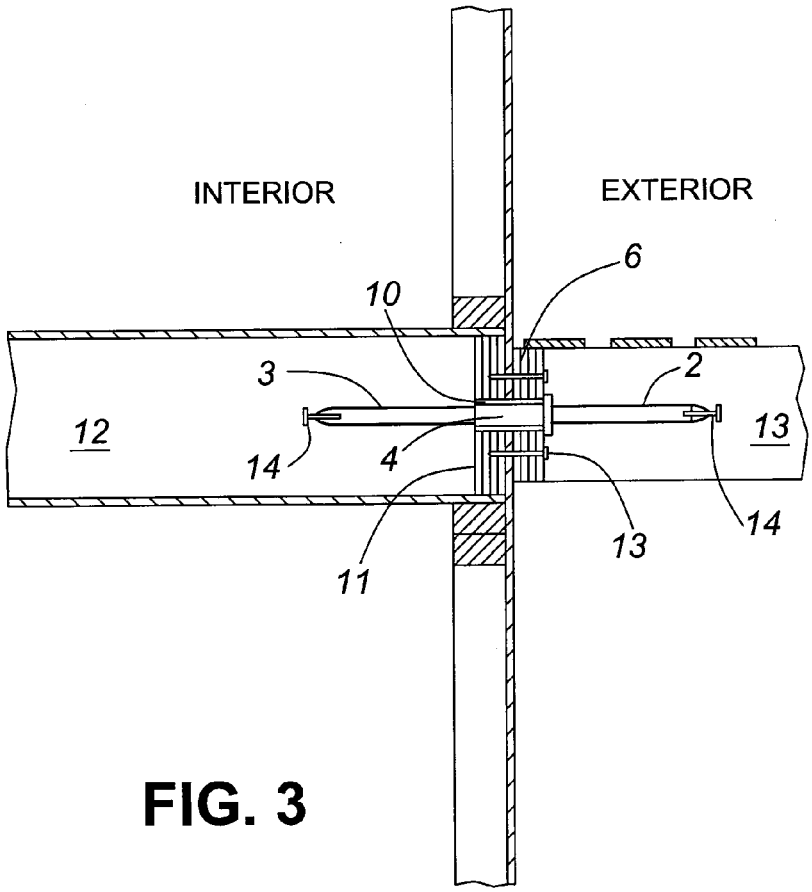
FIG. 3 is a cross-section view of the present connector as installed in a deck structure.
Figure 4:
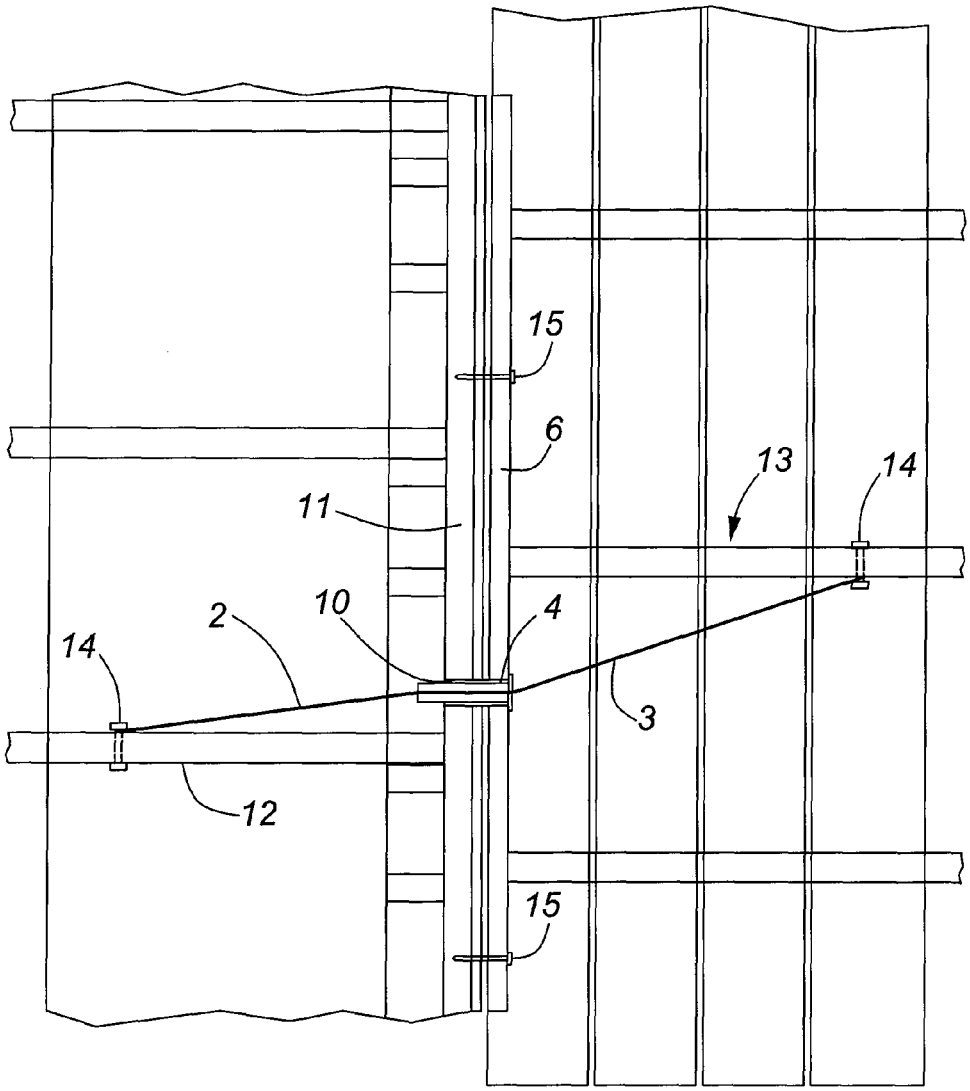
FIG. 4 is a plan view of the present connector as installed in a deck structure.

In a typical installation where joists are off-set (see FIGS. 3 and 4) an aperture or bore (10) is drilled or otherwise formed through the ledger board (7) and the building structure including cladding, sheathing and structural header (11). Loop (3) and the interior end (8) of the plastic plug (4) is then inserted through the aperture (10) until the enlarged head (5) and foam washer (7) contacts the ledger board (6). The length of the plug approximates the depth of such drilled bore, and is typically in the order of 4-6 inches. The interior cable (3) is then fastened securely to an interior joist (12) while the exterior cable (2) is securely and tightly fastened to an exterior joist (13) of the deck structure. The exact method of fastening the cables (2, 3) to the respective joists may entail bolted clamps (14) or other suitable means. Typically two or more such ties are employed, depending on the length of the deck attachment to the building.

Figure 5:
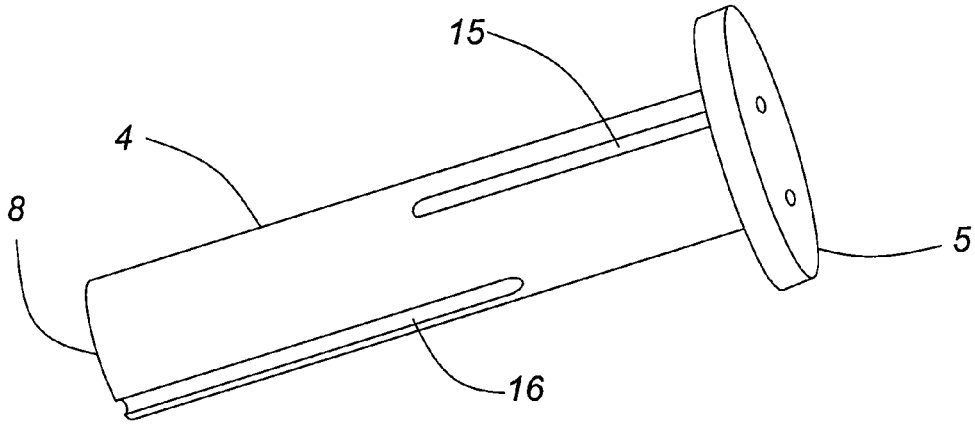
FIG. 5 is a perspective view of the plastic plug of the present invention.
Figure 6:
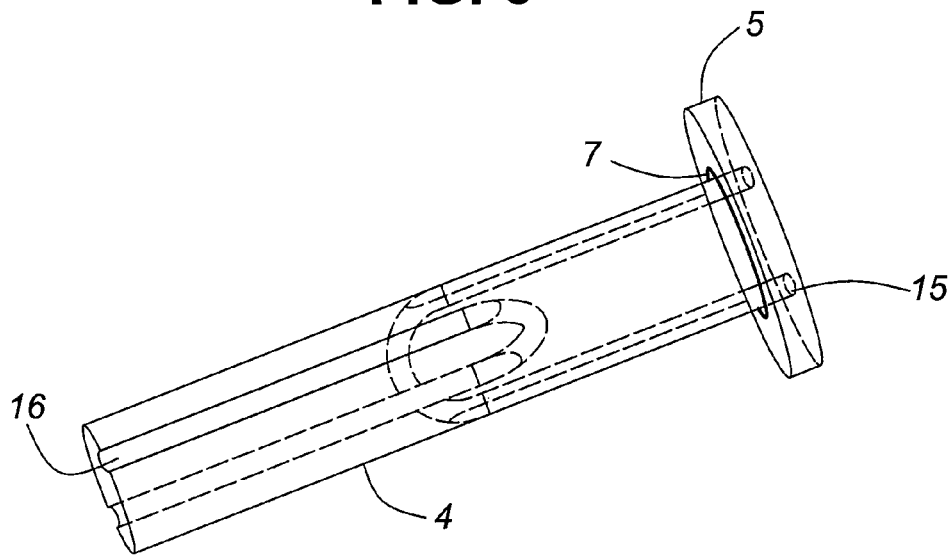
FIG. 6 is a perspective view of the plug of FIG. 5, showing interior passages.

As may be seen in FIGS. 5 and 6, in another embodiment of the invention, the plastic plug (4) may be cast separately from the cable loops, with channels (15) and (16) formed in the casting for receiving cables (2) and (3) respectively. The channels serve to guide and position the cables correctly to maintain the correct thermal separation between the loops. Exposed longitudinal channel portions aid in threading the cables. Alternatively, the plastic plug may be cast around the spaced apart, interlocked cables or linked chain loops.

Figure 7:
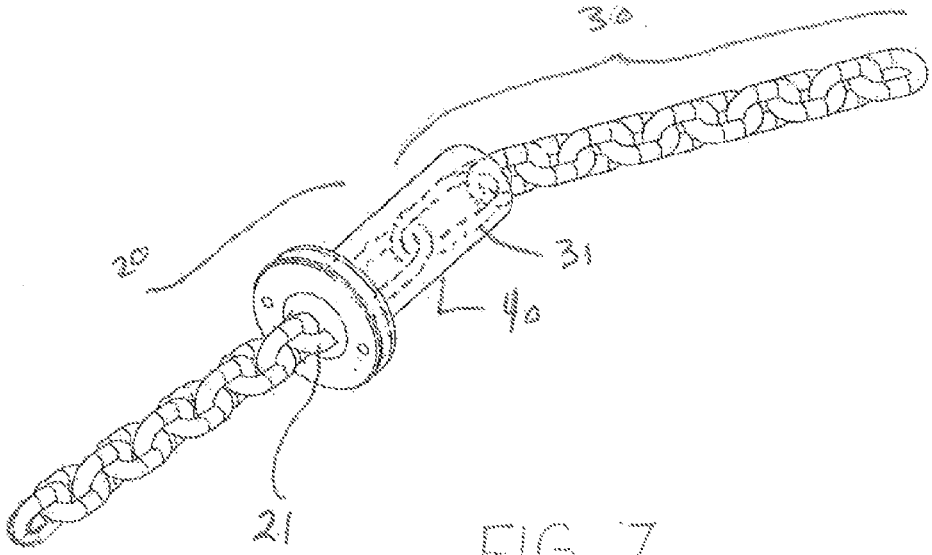
FIG. 7 is a perspective view of a further embodiment of the invention wherein interlocked chains links are used in place of cable loops.

In a further embodiment mentioned above, linked metal chains may replace the wire rope/cable loops. As may be seen in FIG. 7, two lengths if chain, (20 and 30) replace the cable loops (2) and (3) illustrated in FIG. 2. A final link (21) on chain (20) is interlocked with a final link (31) on chain (30), the final links being eneased and spaced apart by plastic plug (40). The space between said final links is filled by the encasing plastic of the plug (40), thereby providing a thermal barrier between the respective chain lengths (20 and 30). The precise extent of each chain length may be selected depending upon the installation set-up and length required. Alternatively chains (20 and 30) may be connected to respective exterior deck and interior joist member at links other than link, thereby offering variable attachment point.

In the event of catastrophic earthquake or hurricane, forces tending to separate the deck and ledger board from the building structure apply a tensile load on the attachment means, such as nails or lag bolts (14). However, the present connector, being attached to the interior and exterior joists, ties the deck structure to the building structure and prevents its removal. In the further event that forces exceeding the rupture strength of the plastic plug are applied to the connector, the plug may be crushed, allowing the cable loops or chain links to come into contact. However, as the loops are interlocked, a solid physical connection remains to prevent the joists and ledger board of the deck structure from being detached from the building structure. This feature complies with the International Residential Code (IRC) revised by the ICC in 2009. In the event of such extreme damage, of course, the plugs must ultimately be replaced, but the device has served its purpose of retaining the deck structure to the building.

In addition to the adaptability of the present plug to attach off-set joists, as well as to attach joists in alignment, the present device also provides a thermal barrier between the conductive metal of the loops, thereby resisting any transmittal of extreme temperatures between the exterior and interior of the structure. This feature eliminates interior condensation, corrosion and ultimately mold and wood rot occurrences within the building structure.

While the foregoing illustrates specific embodiments of the invention, variations in size, strength, and materials are within the ordinary skill of a person skilled in the art and are within the scope of the present invention which is defined by the following claims.

What is claimed is:

1. A structural connector device adapted to connect an exterior deck structure to an interior structural element of a building, the device comprising:

a first flexible tensile loop adapted to connect to said deck structure and a second flexible tensile loop, adapted to connect to said interior structural element, the loops being interlocked, and an elongated cylindrical plastic plug encasing and constraining the interlocked portions of the first and second tensile loops to maintain a separation between the loops.

2. The connector device of claim 1 wherein the separation between the interlocking loops is filled by the plastic plug and forms a thermal barrier.

3. The connector device of claim 1 wherein the elongated plastic plug has an enlarged head at one end thereof.

4. The connector device of claim 3 wherein the plastic plug has a reinforcing collar at the end opposite the enlarged head.

5. The connector device of claim 3 in which the enlarged head is integral with the elongated plastic plug.

6. The connector device of claim 3 wherein a resilient sealing washer surrounds the elongated plastic plug adjacent the head.

7. The connector device of claim 1, wherein the loops further comprise a length of link chain.

8. A structural connector device adapted to connect an exterior deck structure to an interior structural element of a building, the device comprising:

a first tensile closed link adapted to connect to said deck structure and a second tensile closed link, adapted to connect to said interior structural element, the links being interlocked, and an elongated cylindrical plastic plug encasing and constraining the interlocked portions of the first and second tensile closed links to maintain a separation between the links.

9. The connector device of claim 8 wherein the separation between the interlocked links is filled by the plastic plug and forms a thermal barrier.

10. The connector device of claim 8 wherein the elongated plastic plug has an enlarged head at one end thereof.

11. The connector device of claim 10 wherein the plastic plug has a reinforcing collar at the end opposite the enlarged head.

12. The connector device of claim 11 in which the enlarged head is integral with the elongated plastic plug.

13. The connector device of claim 11 wherein a resilient sealing washer surrounds the elongated plastic plug adjacent the head.

* * * * *